United States Patent [19]

Hosono et al.

[11] 4,342,822

[45] Aug. 3, 1982

[54] METHOD FOR IMAGE DEVELOPMENT USING ELECTRIC BIAS

[75] Inventors: Nagao Hosono, Chofu; Junichiro Kanbe, Tokyo, both of Japan

[73] Assignee: Canon Kabushiki Kaisha, Tokyo, Japan

[21] Appl. No.: 125,674

[22] Filed: Feb. 28, 1980

[30] Foreign Application Priority Data

Mar. 7, 1979 [JP] Japan ..... 54-26454

[51] Int. Cl.[3] ..... G03G 13/09

[52] U.S. Cl. ..... 430/97; 430/122; 430/103; 430/106.6

[58] Field of Search ..... 430/106, 107, 109, 110, 430/111, 137, 903; 427/14.1; 118/647, 653, 657

[56] References Cited

U.S. PATENT DOCUMENTS

| | | | |
|---|---|---|---|
| 3,196,032 | 7/1965 | Seymour | 430/137 |
| 3,703,157 | 11/1972 | Maksymiak et al. | 430/120 |
| 3,893,418 | 7/1975 | Liebman et al. | 118/647 |
| 4,014,291 | 3/1977 | Davis | 118/658 |
| 4,082,681 | 4/1978 | Takayama et al. | 430/127 |
| 4,254,203 | 3/1981 | Oka et al. | 430/111 |

*Primary Examiner*—Richard L. Schilling
*Assistant Examiner*—John L. Goodrow
*Attorney, Agent, or Firm*—Fitzpatrick, Cella, Harper & Scinto

[57] ABSTRACT

Method and apparatus for image development, wherein a space gap between a latent image holding member and a developer carrying member is made wider, at a developing section, than thickness of the developer layer on the surface of the developer carrying member, and both members are opposed each other for developing operation, and wherein the developer to be used is composed of electrically insulative toner particles having an average particle diameter of from 5μ to 30μ and very fine particles having a particle diameter smaller than that of the toner particles and capable of assisting electric charging of the toner particles in a polarity opposite to that of the latent image, the fine particles being added to the toner particles and mixed together.

9 Claims, 11 Drawing Figures

METHOD FOR IMAGE DEVELOPMENT USING ELECTRIC BIAS

BACKGROUND OF THE INVENTION

1. Field of the Invention

This invention relates to a developing method for developing a latent image by the use of a developer and an apparatus therefor, and more particularly to a developing method using a one-component developer, especially a developing method which enables obtainment of fogless visible images excellent in sharpness and tone reproduction, and an apparatus therefor.

2. Description of the Prior Art

Various types of developing method using a one-component developer are heretofore known such as the powder cloud method which uses toner particles in cloud condition, the contact developing method in which a uniform toner layer formed on a toner supporting member comprising a web or a sheet is brought into contact with an electrostatic image bearing surface to effect development, and the magnedry method which uses a conductive magnetic toner formed into a magnetic brush which is brought into contact with the electrostatic image bearing surface to effect development.

Among the above-described various developing methods using one-component developer, the powder cloud method, the contact developing method and the magnedry method are such that the toner contacts both the image area (the area to which the toner should adhere) and the non-image area (the background area to which the toner should not adhere) and therefore, the toner more or less adheres to the non-image area as well, thus unavoidably creating the so-called fog.

To avoid such fog or background toner deposition, there has been proposed the transfer development with space between toner donor and image bearing member in which a toner layer and an electrostatic image bearing surface are disposed in opposed relationship with a space gap therebetween in a developing process so that the toner is caused to fly to the image area by the electrostatic field thereof and the toner does not contact the non-image area. Such development is disclosed, for example, in U.S. Pat. Nos. 2,803,177; 2,758,525; 2,838,997; 2,839,400; 2,862,816; 2,996,400; 3,232,190 and 3,703,157. This development is a highly effective method in preventing the fog. Nevertheless, the visible image obtained by this method generally suffers from the following disadvantages because it utilizes the flight of the toner resulting from the electric field of the electrostatic image during the development.

A first disadvantage is the problem that the sharpness of the image is reduced at the edges of the image. The state of the electric field of the electrostatic image at the edge thereof is such that if an electrically conductive member is used as the developer supporting member, the electric lines of force which emanate from the image area reach the toner supporting member so that the toner particles fly along these electric lines of force and adhere to the surface of the photosensitive medium, thus effecting development in the vicinity of center of the image area. At the edges of the image area, however, the electric lines of force do not reach the toner supporting member due to the charge induced at the non-image area and therefore, the adherence of the flying toner particles is very unreliable and some of such toner particles barely adhere while some of the toner particles do not adhere. Thus, the resultant image is an unclear one lacking sharpness at the edges of the image area, and line images, when developed, give an impression of having become thinner than the original lines.

To avoid this in the above-described toner transfer development, the clearance between the electrostatic image bearing surface and the developer supporting member surface must be sufficiently small (e.g. smaller than 100$\mu$) and actually, accidents such as pressure contact of the developer and mixed foreign substances are liable to occur between the two surfaces. Also, maintaining such a fine clearance often involves difficulties in designing of the apparatus.

A second problem is that images obtained by the above-described toner transfer development usually back toner reproducibility. In the toner transfer development, the toner does not fly until the toner overcomes the binding power to the toner supporting member by the electric field of the electrostatic image. This power which binds the toner to the toner supporting member is the resultant force of the Van der Waals force between the toner and the toner supporting member, the force of adherence among the toner particles, and the reflection force between the toner and the toner supporting member resulting from the toner being charged. Therefore, flight of the toner takes place only when the potential of the electrostatic image has become greater than a predetermined value (hereinafter referred to as the transition threshold value of the toner) and the electric field resulting therefrom has exceeded the aforementioned binding force of the toner, whereby adherence of the toner to the electrostatic image bearing surface takes place. But the binding power of the toner to the supporting member differs in value from particle to particle or by the particle diameter of the toner even if the toner has been manufactured or prepared in accordance with a predetermined prescription, and therefore, it is considered to be distributed narrowly around a substantially constant value and correspondingly, the threshold value of the electrostatic image surface potential at which the flight of toner takes place also seems to be distributed narrowly around a certain constant value. Such presence of the threshold value during the flight of the toner from the supporting member causes adherence of the toner to that part of the image area which has a surface potential exceeding such threshold value, but causes little or no toner to adhere to that part of the image area which has a surface potential lower than the threshold value, with a result that there are only provided images which lack the tone gradation having steep $\gamma$ (the gradient of the characteristic curve of the image density with respect to the electrostatic image potential).

In view of such problems, a developing device in which a pulse bias of very high frequency is introduced across an air gap to ensure movement of charged toner particles flying through the air gap, whereby the charged toner particles are made more readily available to the charged image is disclosed in U.S. Pat. Nos. 3,866,574; 3,890,929 and 3,893,418.

Such high frequency pulse bias developing device may be said to be a developing system suitable for the line copying in that a pulse bias of several KHz or higher is applied in the clearance between the toner donor member and the image retaining member to improve the vibratory characteristic of the toner and prevent the toner from reaching the non-image area in any pulse bias phase but cause the toner to transit only to the image area, thereby preventing fogging of the non-image area. However, the aforementioned U.S. Pat. No. 3,893,418 states that a very high frequency (18 KHz–22 KHz) is used for the applied pulse voltage in order to make the device suitable for the reproduction of tone gradation of the image.

U.S. Pat. No. 3,346,475 discloses a method which comprises immersing two electrodes in insulating liquid contained in a dielectrophoretic cell and applying thereto an AC voltage of very low frequency (lower than about 6 Hz) to thereby effect the development of a pattern corresponding to the conductivity variance.

Further, U.S. Pat. No. 4,014,291 discloses a method in which dry, one component magnetic toner on the non-magnetic, non-conductive transfer cylinder which encloses a rotating cylindrical magnet is transferred to the deposit zone to develop an electrostatic latent image on coated paper, but this patent does not suggest that a bias is applied for the above-described purpose.

Further method for the image development is described in pending U.S. Patent applications Ser. No. 58,434 and No. 58,435 of the same assignee-to-be as that of the present application.

Thus, in order to obtain a toner image of good quality, the space gap between the electrostatic image holding member and the developer carrying member should be as close as possible at the developing section, e.g., 100μ to 200μ. By so doing, satisfactory polarity effect would appear, whereby an electric field due to the electrostatic latent image truthfully reaches the developer layer on the developer carrying member and good toner image can be obtained. This means that, since the developer layer on the developer carrying member should be extremely thin so as not to cause the developer to eventually contact the non-image portion.

Uniform application of the developer on the developer carrying member in such thin thickness (e.g., approx. 60μ to 150μ) has been difficult by the above-described conventional methods. Also, sure and uniform charging of each and every particle of the electrically insulative toner on the developer carrying member makes it necessary to reduce thickness of the toner layer on the developer carrying member to the thinnest possible extent, even when the frictional charging method, for example, is adopted for charging the toner on the developer carrying member. To attain this purpose, the developer is desired to have good fluidity and be readily chargeable.

More important in this developing method are that each and every toner particle is surely charged in an intended polarity, that each and every toner particle has good separability, and that the toner particles are in a state of being readily spattered in accordance with the electrostatic latent image field. These are the requisite conditions for obtaining a good quality image.

Furthermore, it is necessary that the developer which has adhered onto a part of the non-image portion due to the abovementioned alternating field be readily removed from the surface of the electrostatic image holding member by a subsequently applied opposite field. Without this condition being fulfilled, there would occur fogging phenomenon on the non-image portion. It is also desired that the toner particles are surely charged in an intended polarity.

As stated in the foregoing, and, particularly, in these developing methods, the developer layer should be coated on the developer carrying member to the thinnest possible extent. It is also desired that the toner particles constituting the developer be surely charged in an intended polarity, have good separability and high fluidity without being coagulated, and be easily spattered by the electric field.

SUMMARY OF THE INVENTION

It is an object of the present invention to provide a method and an apparatus capable of solving various problems inherent in the conventional methods and apparatus, and of realizing high quality and stable image development using an electrically insulative toner which is transferable onto plain paper.

It is another object of the present invention to provide a method and an apparatus for image development, wherein a space gap between a latent image holding member and a developer carrying member is made wider, at a developing section, than thickness of the developer layer on the surface of the developer carrying member, and both members are opposed each other for development, and wherein the developer to be used is composed of an electrically insulative toner particles having an average particle diameter of from 5μ to 30μ and very fine particles having a particle diameter smaller than that of the toner particles and capable of assisting electric charging of the toner particles in a polarity opposite to that of the latent image, the fine particles being added to the toner particles and mixed together.

It is still another object of the present invention to provide a method and an apparatus for image development, wherein the electrically insulative toner is a magnetic toner consisting, at least, of a resin material and a magnetic powder.

It is yet another object of the present invention to provide a method and an apparatus for image development, wherein the fine particles having smaller diameter than that of the toner particles are hydrophobic.

It is other object of the present invention to provide a method and an apparatus for image development, wherein an alternating field is applied across the latent image holding member and the developer carrying member for the image development.

It is still other object of the present invention to provide a method and an apparatus for image development, in which there is provided a cleaning device for cleaning the surface of the developer carrying member, and which can attain the effect of exhibiting the image characteristic of good gradation to faithfully reproduce the image density by use of the developer in fine powder form (powder developer, in which the particle size of 15μ or below occupies 90% and above in the particle number distribution), and of extremely good durability even in repeated use.

It is yet other object of the present invention to provide a method and an apparatus for image development, wherein the developer carrying member is opposed to the latent image holding member, an electrically insulative toner which has been subjected to the frictional charging or the contact charging is coated on the developer carrying member, and the toner coated layer is brought in proximity to the latent image holding member for development, the insulative toner containing the toner particles having a size of 4μ or below which occupies 10% or below in the particle size distribution.

Other objects and features of the present invention will become apparent from the following description of some embodiments of the invention taken in conjunction with the accompanying drawings.

DESCRIPTION OF THE PREFERRED EMBODIMENTS

The principle of the bias developing method utilized in the present invention will be described by reference to FIG. 1. In the lower portion of FIG. 1, there is shown a voltage waveform applied to a toner carrier. It is shown as a rectangular wave, whereas it is not restricted thereto. A bias voltage of the negative polarity having a magnitude of Vmin is applied at a time interval t1, and a bias voltage of the positive polarity having a magnitude of Vmax is applied at a time interval t2. When the image area charge formed on the image surface is positive and this is developed by negatively charged toner, the magnitudes of Vmin and Vmax are selected so as to satisfy the relation that $$V_{min} < V_L < V_D < V_{max} \quad (1)$$

where $V_D$ is the image area potential and $V_L$ is the non-image area potential. If so selected, at the time interval t1, the bias voltage Vmin acts to impart a bias field with a tendency to expedite the contact of toner with the image area and non-image area of an electrostatic latent image bearing member and this is called the toner transition stage. At the time interval t2, the bias voltage Vmax acts to impart a bias field with a tendency to cause the toner which as transited to the latent image bearing surface in the time interval t1 to be returned to the toner carrier and this is called the back transition stage.

Figure 1:
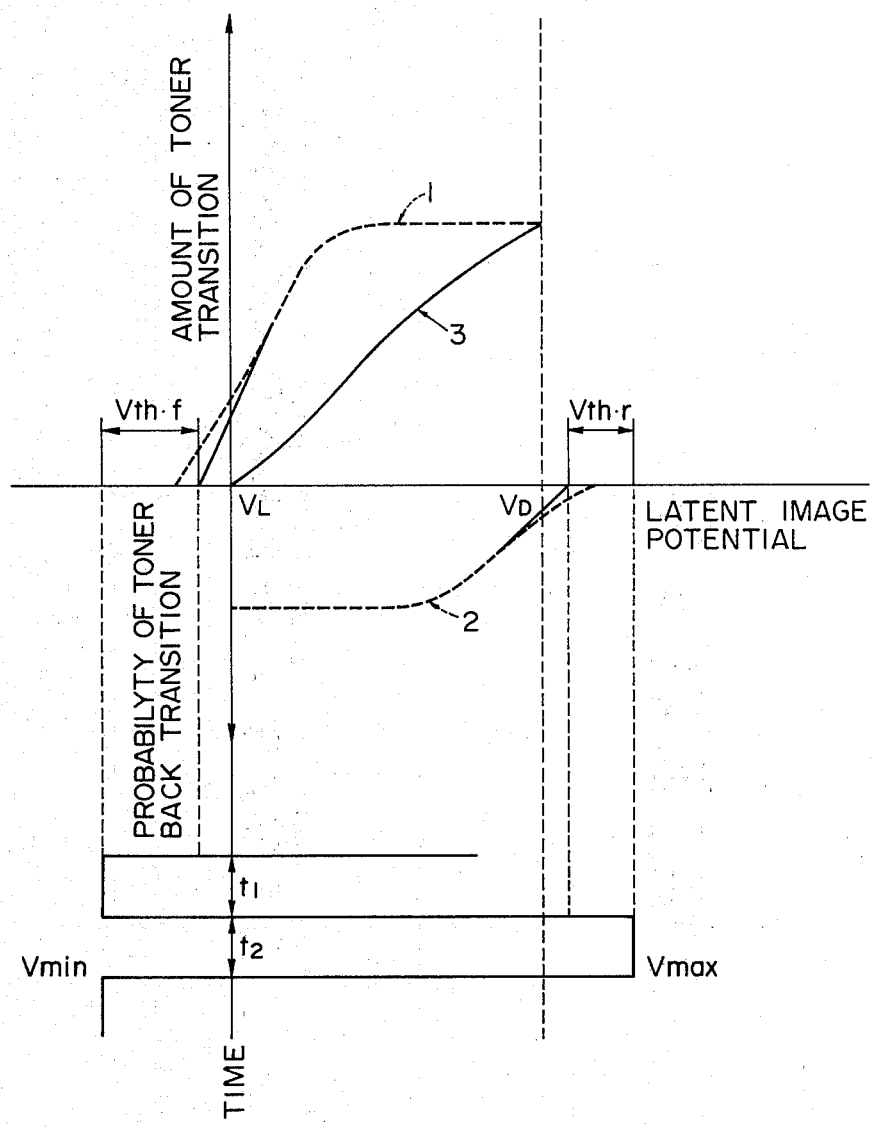
FIG. 1 illustrates the amount of transition of the toner and the characteristic of the degree of toner back transition for the potential of a latent image, as well as an example of the voltage waveform applied.

Vth·f and Vth·r in FIG. 1 are the potential threshold values at which the toner transits from the toner carrier to the latent image surface or from the latent image surface to the toner carrier, and may be considered potential values extrapolated by a straight line from the points of the greatest gradient of the curves shown in the drawing. In the upper portion of FIG. 1, the amount of toner transition at t1 and the degree of toner back transition at t2 are plotted with respect to the latent image potential.

The amount of toner transition from the toner carrier to the electrostatic image bearing member in the toner transition stage is such as curve 1 shown by broken line in FIG. 1. The gradient of this curve is substantially equal to the gradient of the curve when no bias alternative voltage is applied. This gradient is great and the amount of the toner transition tends to be saturated at a value intermediate $V_L$ and $V_D$ and accordingly, it is not suited for reproduction of half-tone images and provides poor tone gradation. Curve 2 indicated by another broken line in FIG. 1 represents the probability of toner back transition.

In the developing method utilized in the present invention, an alternating electric field is imparted so that such toner transition stage and toner back transition stage may be alternately repeated and in the bias phase t1 of the toner transition stage of that alternating electric field, toner is positively caused to temporarily reach the non-image area of the electrostatic latent image bearing member from the toner carrier (of course, toner is also caused to reach the image area) and toner is sufficiently deposited also on the half-tone potential portion having a low potential approximate to the light region potential $V_L$, whereafter in the bias phase t2 of the toner back transition stage, the bias is caused to act in the direction opposite to the direction of toner transition to cause the toner which has also reached the non-image portion as described to be returned to the toner carrier side. In this toner back transition stage, as will later be described, the non-image area does not substantially have the image potential originally and therefore, when a bias field of the opposite polarity is applied, the toner which has reached the non-image area as described tends to immediately leave the non-image area and return to the toner carrier. On the other hand, the toner once deposited on the image area including the half-tone area is attracted by the image area charge and therefore, even if the opposite bias is applied in the direction opposite to this attracting force as described, the amount of toner which actually leaves the image area and returns to the toner carrier side is small. By so alternating the bias fields of different polarities at a preferred amplitude and frequency, the above-described transition and back transition of the toner are repeated a number of times at the developing station. Thus, the amount of toner transition to the latent image surface may be rendered to an amount of transition faithful to the potential of the electrostatic image. That is, there may be provided a developing action which may result in a variation in amount of toner transition having a small gradient and substantially uniform form $V_L$ to $V_D$ as shown by curve 3 in FIG. 1. Accordingly, practically no toner adheres to the non-image area while, on the other hand, the adherence of the toner to the half-tone image areas takes place corresponding to the surface potential thereof, with a result that there is provided an excellent visible image having a very good tone reproduction. This tendency may be made more pronounced by setting the clearance between the electrostatic latent image bearing member and the toner carrier so that it is greater toward the termination of the developing process and by decreasing and converging the intensity of the above-mentioned electric field in the developing clearance.

Figure 2A:
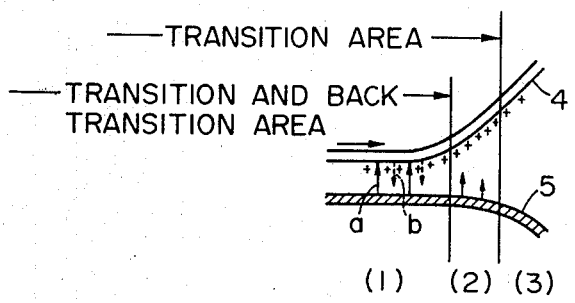
FIGS. 2A and 2B illustrate the process of the developing method according to the present invention.
Figure 2B:
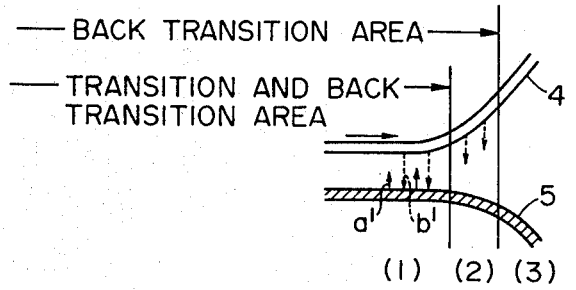
Figure 2C:
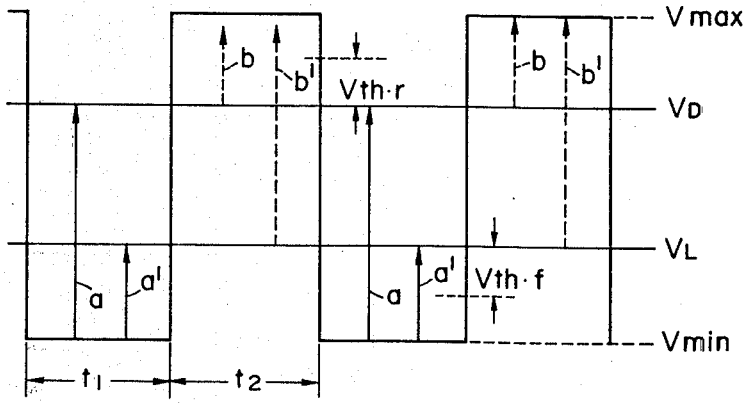
FIG. 2C shows an example of the applied voltage waveform.

An example of such developing process utilized in the present invention is shown in FIGS. 2A and 2B. As shown in FIGS. 2A and 2B, the electrostatic image bearing member 4 is moved in the direction of arrow through developing regions (1) and (2) to a region (3). Designated by 5 is a toner carrier. Thus, the electrostatic image bearing surface and the toner carrier gradually widen the clearance therebetween from their most proximate position in the developing station. FIG. 2A shows the image area of the electrostatic image bearing member and FIG. 2B shows the non-image area thereof. The direction of arrows shows the direction of the electric fields and the length of the arrows indicates the intensity of the electric fields. It is important the electric fields for the transition and back transition of the toner from the toner carrier are present also in the non-image area. FIG. 2C shows a rectangular wave which is an example of the waveform of the alternate current applied to the toner carrier, and schematically depicts, by arrows in the rectangular wave, the relation between the direction and intensity of the toner transition and back transition fields. The shown example refers to the case where the electrostatic image charge is positive, whereas the invention is not restricted to such case. When the electrostatic image charge is positive, the relations between the image area potential $V_D$, the non-image area potential $V_L$ and the applied voltages Vmax and Vmin are set as follows:

$$\left.\begin{array}{l} |V\max - V_L| > |V_L - V\min| \\ |V\max - V_D| < |V_D - V\min| \end{array}\right\} \quad (2)$$

In FIGS. 2A and 2B, a first process in the development occurs in the region (1) and a second process occurs in the region (2). In the case of the image area shown in FIG. 2A, in the region (1), both of the toner transition field a and the toner back transition field b are alternately applied correspondingly to the phase of the alternate field and the transition and back transition of the toner result therefrom. As the developing clearance becomes greater, the transition and back transition fields become weaker and the toner transition is possible in the region (2) while the back transition field sufficient to cause the back transition (below the threshold value |Vth·r|) becomes null. In the region (3), neither transition takes place any longer and the development is finished.

In the case of the non-image area shown in FIG. 2B, in the region (1), both the toner transition field a' and the toner back transition field b' are alternately applied to create the transition and back transition of the toner. Thus, fog is created in this region (1). As the clearance is wider, the transition and the back transition field become weaker and when the region (2) is entered, the toner back transition is possible while the transition field sufficient to cause transition (below the threshold value) becomes null. Thus, in this region, fog is not substantially created and the fog created in the region (1) is also sufficiently removed in this stage. In the region (3), the back transition neither takes place any longer and the development is finished. As regards the half-tone image area, the amount of toner transition to the final latent image surface is determined by the magnitudes of the amount of toner transition and the amount of toner back transition corresponding to that potential, and after all, there is provided a visible image having a small gradient of curve between the potentials $V_L$ to $V_D$, as shown by curve 3 in FIG. 1, and accordingly having a good tone gradation.

In this manner the toner is caused to fly over the developing clearance and is caused to temporarily reach the non-image area as well to improve the tone gradation, and in order that the toner having reached the non-image area may be chiefly stripped off toward the toner carrier, it is necessary to properly select the amplitude and alternating frequency of the alternate bias voltage applied.

Such application of the alternate bias, of lower frequency brings about remarkable enhancement of the tone gradation, but the voltage value thereof must be properly set. That is, too great a value for the |Vmin| of the alternate bias may result in an excessive amount of toner adhering to the non-image area during the toner transition stage and this may prevent sufficient removal of such toner in the developing process, which in turn may lead to fog or stain created in the image. Also, too great a value for |Vmax| would cause a great amount of toner to be returned from the image area, thus reducing the density of the so-called solid black portion. To prevent these phenomena and to sufficiently enhance the tone gradation, Vmax and Vmin may preferably and reasonably be selected to the following degrees:

$$V\max \simeq V_D + |V\text{th}\cdot r| \quad (3)$$

$$V\min \simeq V_L + |V\text{th}\cdot f| \quad (4)$$

Vth·f and Vth·r are the potential threshold values already described. If the voltage values of the alternate bias are so selected, the excess amount of toner adhering to the non-image area in the toner transition stage and the excessive amount of toner returned from the image area in the back transition stage would be prevented to ensure obtainment of proper development.

The foregoing description has been made with respect to the case where the image area potential VD is positive, whereas the present invention is not restricted thereto but it is also applicable to a case where the image area potential is negative and in this latter case, if the positive of the potential is small and the negative of the potential is great, the present invention is equally applicable. Therefore, when such image area charge is negative, the aforementioned formulas (1)–(4) are represented as the following formulas (1')–(4').

$$V\max > VL > VD > V\min \quad (1')$$

$$\left.\begin{array}{l} |V\min - VL| > |VL - V\max| \\ |V\min - VD| < |VL - V\max| \end{array}\right\} \quad (2')$$

$$V\min \simeq VD - |Vth \cdot r| \quad (3')$$

$$V\max \simeq VL + |Vth \cdot f| \quad (4')$$

In the following preferred examples of the present invention will be explained.

EXAMPLE 1

Figure 3A:
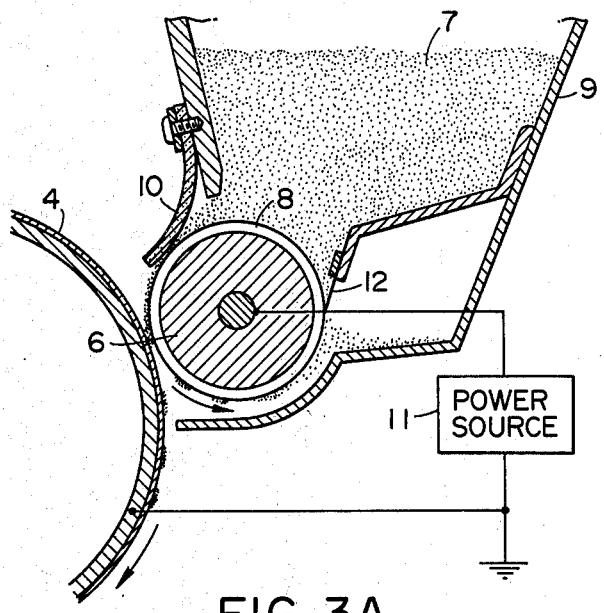
FIG. 3A is a schematic cross-sectional view of one embodiment of the developing apparatus to practise the developing method according to the present invention.
Figure 3B:
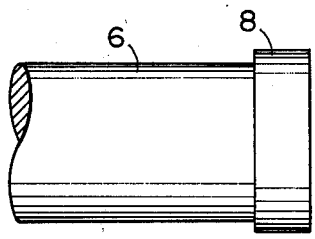
FIG. 3B is a partial side view of the developer carrying member used for the developing apparatus shown in FIG. 3A.

FIG. 3A schematically shows one example of the electrostatic image developing apparatus using a non-magnetic toner. In the drawing, a reference numeral 4 designates an electrostatic image holding member, on which an electrostatic image is formed by a known method such as, for example, electrophotographic method. The electrostatic image formed on the image holding member 4 is developed by a developer 7 coated on a developer carrying member 6. A ring-shaped spacer 8 made of high density polyethylene is fitted at both ends of the developer carrying member 6, as shown in FIG. 3B. By contacting the spacer 8 with the electrostatic image holding member 4 to fix the developing device in position, a space gap between the electrostatic image holding member 4 and the developer carrying member 6 is maintained at 150 μm. Surface irregularity of approximately 3μ to 6μ or so is given to the developer carrying member 6 by the sand blast method. The developer 7 in a hopper 9 is applied on the developer carrying member 6 by means of a coating blade 10 made of an elastic material such as rubber plate, polyester film, and so forth. Thickness of the coated layer of the developer is approximately 80μ.

The peripheral speed of the electrostatic image holding member 4 (a photosensitive drum using a photosemiconductor) having thereon an electrostatic image is made equal with the peripheral speed of the developer layer on the developer carrying member 6, and the image development is done by rotating the developer lay in the direction of its follow movement. A numeral 11 refers to a bias power source for development which is so constructed that the abovementioned a.c. voltage may be applied to the electrically conductive developer carrying member 6. A numeral 12 refers to a scraper for removing the developer remaining on the developer carrying member after the image developing operation.

The developing agents used are: (1) the toner for "NP5000" copying machine of Canon K.K. (having average particle diameter of 7 microns) alone; and (2) the same toner as mentioned above plus 0.4 weight % of hydrophobic silica ("AEROSIL R972", a product of Nippon Aerosil K.K.) having average particle size of 16 mμ, both being mixed and well agitated. These two kinds of developing agents are used for comparison purpose. The electrostatic latent image is formed by the NP electrophotographic method as disclosed in, for example, U.S. Pat. Nos. 3,666,363 and 4,071,361, which latent image is in the positive polarity. The comparative results reveal that the developing density is higher with the toner mixed with the hydrophobic silica "AEROSIL R972", and a visible image of good quality can be obtained thereby.

EXAMPLE 2

Figure 4:
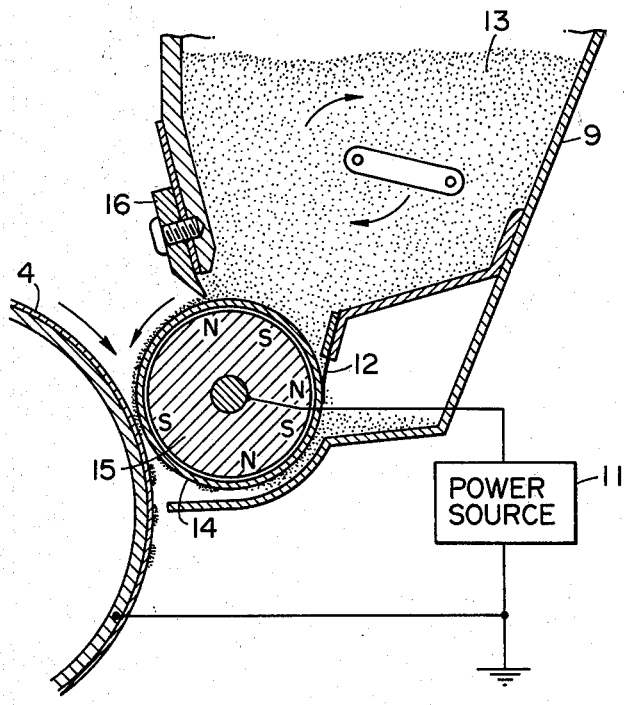
FIG. 4 is a schematic cross-sectional view of another embodiment of the apparatus for practising the developing method according to the present invention.

FIG. 4 shows a schematic diagram of the embodiment, in which the image developing operation is effected by use of the electrically insulative magnetic toner 13. A reference numeral 4 designates an electrostatic image holding member having, on its surface, an electrostatic latent image obtained by the known electrophotographic method. A numeral 14 refers to a developing sleeve as a non-magnetic developer carrying member having in its interior a fixed magnet roll 15. The developing section is in such a layout that one of the magnet poles of the magnet pole (e.g. the S-pole of approx. 650 gausses in the illustration) is disposed in the interior of the developing sleeve 15 opposite the electrostatic image holding member 4, and the space gap between the developing sleeve 14 and the electrostatic image holding member 4 is maintained at 300 μm by the same way as in the previous example shown in FIG. 3A. A numeral 16 refers to a blade made of a magnetic material, which controls the magnetic developer 13 in the hopper 9 to an intended layer thickness. Thus, the toner is toriboelectrically charged between the blade and the developing sleeve 14, and is coated on its surface due to electrostatic force therebetween. In confrontation to this magnetic blade 16, there is disposed, inside the developing sleeve 14, the other magnet pole (e.g., N-pole in the illustration) of the magnet roll 15. In this case, the space gap between the developing sleeve 14 and the magnetic blade 16 is set at 250 μm, and the layer thickness of the magnetic developer 13 on the developing sleeve 14 as the developer carrying member is regulated by the magnetic field between the magnetic blade 16 and the developing sleeve 14. The rotational direction of the developing sleeve 14 is the same as that of the previous example shown in FIG. 3A. The toner used as the developing agent is one having an average particle diameter of approximately 12 microns and consisting principally of an ethylene/vinyl acetage copolymer resin and 30% by weight of a magnetic powder ("CAP-2", 2 product of Tokyo Denki Kagaku Kogyo K.K.). Of the kinds of the toner, the first toner consists of this toner alone as the developing agent, and the second toner consists of the toner added with 0.2% by weight of powdery aluminum oxide ("ALUMINUM OXIDE C", a product of Nippon Aerosil K.K.) having an average particle diameter of 20 mμ. The third toner consists of the toner added with 0.2% by weight of hydrophilic silica ("AEROSIL 200", a product of Nippon Aerosil K.K.) having an average particle diameter of 12 mμ. Further, the fourth toner consists of the toner added with 0.2% by weight of hydrophobic silica ("AEROSIL R972", a product of Nippon Aerosil K.K.) having an average particle diameter of 16 mμ. The fifth toner consists of the toner added with 0.2% by weight of hydrophobic silica ("TULANOC TM500", a product of Tulco Co.) having an average particle diameter of 7 mμ. These toners are used for comparison. Incidentally, the surface potential of the electrostatic latent image on the electrostatic image holding member 4 is approximately +500 V at the dark portion, and substantially zero volt at the bright portion. At the time of the development, the following voltage waveform is applied to the developing sleeve 14 by the developing bias power source 11: an alternating voltage having a sinusoidal waveform of 200 Hz in frequency and 800 V pp in its peak value, on which a d.c. voltage of +200 V is superposed. A numeral 12 is the scraper as mentioned above.

The result of the image development reveals that the fogging occurs in the non-image portion when the first toner alone is used, the development density is low, and the image quality is poor. However, when the second, third, fourth and fifth toners are used, the resulting development density is almost satisfactory, and the resulted visible image is of high quality with sharp image and good gradation free from the undesirable fogging. Thickness of the developer layer coated on the developing sleeve 14 is approximately 80 μm with the first toner, while it is almost 100 μm to 160 μm with the second, third, fourth and fifth toners, the developer layer as coated being uniform and dense in comparison with the case of using the first toner alone. However, under a highly moist condition, when the second toner added with aluminum oxide powder and the third toner added with the hydrophilic silica are used, there is observed decrease in the development density and the resulted image quality is poor. Incidentally, when 0.2% by weight of hydrophilic silica ("TULANOC TM500", a product of Tulco Co.) is added to the magnetic toner in positive polarity, and the image development is effected with the developer, it is discovered that the toner becomes no longer charged accurately to the positive polarity. It has also been discovered here that the very fine particles which are added to the toner particles and have a smaller particle diameter than the toner particles, and which assist electric charging of the toner to a polarity opposite that of the electrostatic latent image are almost developed along with the toner particles at the time of the image developing operation with the consequence that there is no possibility of the very fine particles remaining on the developed image to cause mal-effect to the developing operation, hence stable and high quality image can always be obtained. According to this developing method as described herein, the coated condition itself of the developer layer on the developer carrying member 14 reflects on visualization of the latent image as the toner image. Therefore, the coated condition of this developer layer is particularly important. According to the present invention, the toner particles are mainly charged toriboelectrically between the magnetic blade 16 and the developing sleeve 14 to make it possible to form a uniform and dense developer layer with the least coagulation, whereby very clear and sharp toner image can be obtained.

EXAMPLE 3

In the developing apparatuses of a construction as shown in FIGS. 3A and 3B, there is used a developing agent prepared by mixing 0.3% by weight of hydrophobic silica ("AEROSIL R972", a product of Nippon Aerosil K.K.) with the toner consisting principally of an ethylene/vinyl acetate copolymer resin and 8% by weight of carbon black. Of the developers used, one developer has an average particle diameter of 12 microns, in which the particle number distribution of the toner particles of 4 microns and below is 20%, and another developer has an average particle diameter of 14 microns as the result of removing very fine particles out of the toner particles by classification, in which the particle number distribution of the toner particles of 4 microns and below is approximately 10%. Both developers are mainly used to comparing stability in the developing density. The electrostatic latent image is formed by the afore-mentioned NP electrophotographic method, which is a positive latent image. When ten thousands sheets of copies (A-3 size copy according to JIS) are continuously produced by use of the respective developers, it has been found out that the developing density remarkably lowers from that at the initial stage when the developer containing the toner particles having the particle number distribution of 20% in the particle diameter of 4 microns and below in comparison with the developer containing the toner particles having the particle number distribution of approximately 10% in the particle size of 4 microns and below. In this instance, the developer carrying member 2 is grounded for the image development operation.

EXAMPLE 4

In the developing apparatus of a construction as shown in FIG. 4, there is used a developing agent prepared by mixing and agitating 0.4% by weight of hydrophobic silica ("AEROSIL R972", a product of Nippon Aerosil K.K.) with the toner consisting principally of the toner constituent (a composition of an ethylene/vinyl acetate copolymer resin and carbon black) and 30% by weight of magnetic powder ("CAP-2", a product of Tokyo Denki Kagaku Kogyo K.K.). Of the developers thus prepared, one developer has an average particle diameter of approximately 11 microns, in which the particle number distribution of the toner particles having the particle size of 4 microns and below is approximately 20%, and another developer has an average particle size of approximately 13 microns, in which the particle number distribution of the toner particles having the particle size of 4 microns and below is approximately 10%. These developers are mainly used for comparing stability in the developing density. When ten thousands sheets of copies (A-3 size copy according to JIS) are continuously produced by use of the respective developers, it has been found out that the developing density remarkably lowers from that at the initial stage when the developer containing the toner particles having the particle number distribution of approximately 20% in the particle diameter of 4 microns and below in comparison with the developer containing the toner particles having the particle number distribution of approximately 10% in the particle size of 4 microns and below. In this instance, the developer layer coated on the developing sleeve 14 in the region where the developer is not consumed is particularly thin, and fine powder is found to have been coated on the surface of the developing sleeve 14. The fine powder is no longer consumed by the image developing operation, but is rigidly adhered onto the surface of the developing sleeve 14. In this case, the developing agent is regulated to a desired thickness by the magnetic blade 16, adheres onto the developing sleeve by being charged between the magnetic blade and the developing sleeve, and is conveyed to the developing region. Accordingly, the reason for decrease in the developing density may be considered as follows: very fine particles of the tone electrostatically and rigidly adhere onto the surface of the developing sleeve 14 to cover the same, whereby most of the toner particles in the particle size which tend to be readily developed are not sufficiently charged and adhered between the magnetic blade and the developing sleeve. The scraper 12 also has a function of improving this point.

EXAMPLE 5

In FIG. 4, the scraper 12 constitutes the cleaning blade for the surface of the developing sleeve 14. This cleaning blade is of such a construction that it is press-contacted to the sleeve surface with a uniform line contact. The material for the blade should preferably have elasticity. In addition, metals, plastics, and rubbers may be used. Whichever material is used, the cleaning blade should be press-contacted onto the surface of the developing sleeve by its own elasticity to remove substantially perfectly the residual toner particles adhered onto the sleeve surface, or the fine powders which adheres toriboelectrically and rigidly on the sleeve and which do not contribute to the image developing operation. It has been found out that, when a phosphor bronze plate of 100 microns thick is contacted onto the surface of the stainless steel developing sleeve with a linear contact pressure of approximately 30 g/cm, substantially perfect cleaning is possible.

Figure 5:
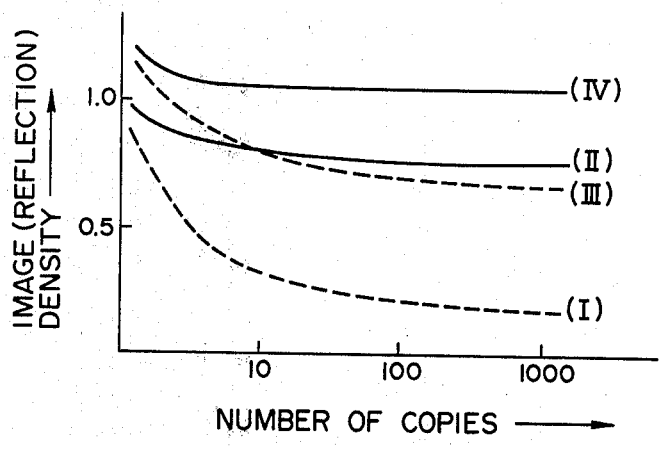
FIG. 5 is a graphical representation showing a characteristic of the copy sheet number versus image density.
Figure 6:
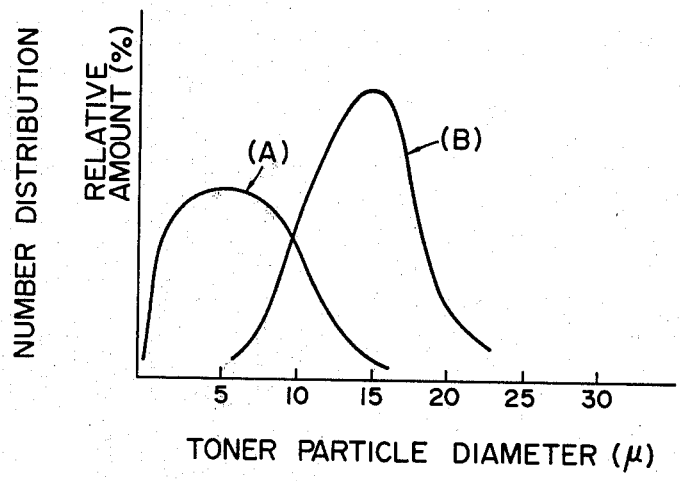
FIG. 6 is another graphical representation showing a characteristic of the toner particle diameter versus particle number distribution.

Using this cleaning blade, when a latent image is developed with a developer containing fine powder in a comparatively large quantity, there is obtained a result as shown by a curve (II) in FIG. 5. It is to be noted that, in this graphical representation, the curve (I) indicates the density change when no cleaning blade is provided, and the curve (II) indicates the density change when the cleaning blade is provided. The particle size distribution of the toner particles in this case is shown by a curve (A) in FIG. 6. Further, changes in the image density when the toner of the same material having the particle size distribution as shown by a curve (B) in FIG. 6 are shown by the curves (III) and (IV) in FIG. 5. The curve (III) indicates a case when no blade is provided, and the curve (IV) indicates a case when the blade is provided.

The developing agent used in the experiments consists of 100 parts of polystyrene ("PICOTESTIC D-125"), 2 parts of controlling agent ("Zapon First Black B"), 6 parts of carbon black ("REGAL 400R"), and 40 parts of magnetite ("EPT-500" produced by Toda Kogyo K.K.). The toner is negatively charged on the developing sleeve, the charge potential of which indicates approximately −20 V. When this toner is used for developing a latent image having a surface potential of about 400 V (formed on the photosensitive member having thereon an insulative film ("MYLAR" in trade name) of a thickness of 30 microns), there can be obtained the results as shown in FIG. 5.

By cleaning the surface of the developing sleeve as mentioned above, there can be obtained sufficiently stable developing density even with the toner containing therein fine powder. Furthermore, owing to such fine toner particles, the resolution or gradation in the image obtained tends to be excellent, as shown in FIGS. 7 and 8.

Figure 7:
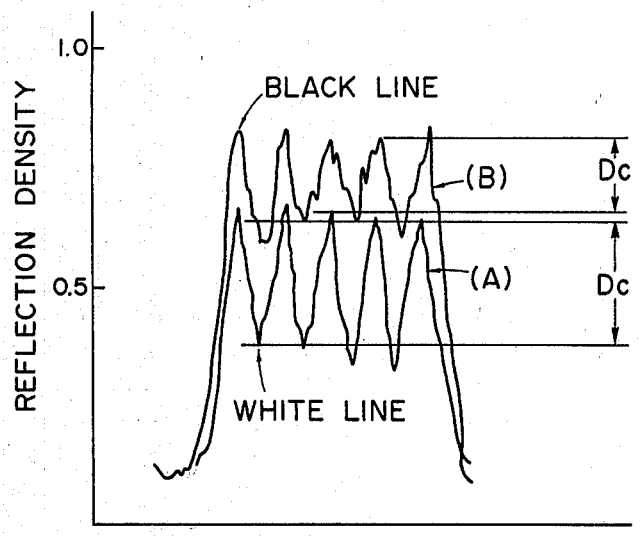
FIG. 7 is still another graphical representation showing a characteristic of an image versus reflection density of developed image.
Figure 8:
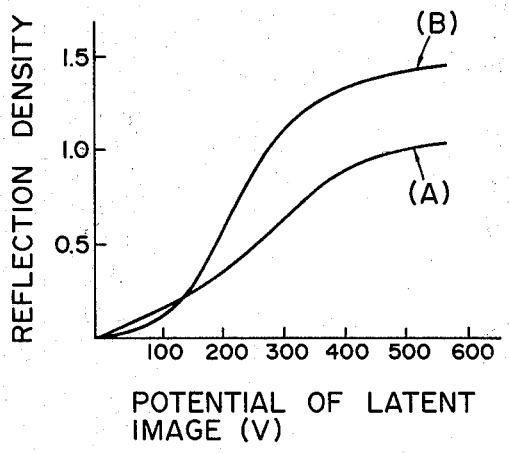
FIG. 8 is yet another graphical representation showing a characteristic of latent image potential versus reflection density of the developed image.

FIG. 7 shows comparative results of the image resolution when an image original consisting of eight lines pairs in millimeter is reproduced by the use of the toners (A) and (B) having the particle size distribution as shown in FIG. 6. When the reflection density contrast Dc in the images developed by the toners (A) and (B) has been compared, it is found out that the maximum toner density of the toner (A) is at least approximately twice as high as that of the toner (B) in terms of the image contrast. FIG. 8 shows comparative results of the gradation in the images obtained. Although the maximum density of the toner (A) is lower than that of the toner (B), its variation is substantially linear in correspondence to variations in the latent image potential, whereby the gradation which is very close to the variations in the image original is reproduced.

As stated in the foregoing, practically excellent image characteristics can be stably reproduced by the combined use of the sleeve surface cleaning device for the toner containing a large quantity of fine powder, i.e., the toner, in which the particle size of 15 microns or below occupies 90% and higher in the particle number distribution.

It should be noted that the present invention is not limited to the foregoing embodiments. It should also be understood that the present invention provides the developing method which can be suitably applied for developing a latent image formed not only by the electrophotographic method, but also by other well known methods such as electrostatic recording method, and so forth, and can be very effectively applied not only to the developing methods of a type, in which the insulative magnetic toner is conveyed to the developing section in utilization of a magnetic field, but also to this kind of developing method, in which the insulative toner (single component toner) is used.

What we claim is:

1. A developing method comprising:
(a) arranging a latent image holding member and a developer carrying member at spaced mutually opposed positions, and providing a space gap therebetween at a developing section, wherein said gap is maintained greater than a thickness of a developer layer applied on the surface of said developer carrying member;
(b) applying an alternating electric field across the space gap; and
(c) using a developer prepared by mixing electrically insulative toner particles having an average particle diameter of from 5 microns to 30 microns with very fine powder particles having a smaller particle diameter than said toner particles and capable of assisting electric charging of said toner particles in a polarity opposite to that of a latent image, and wherein the toner particles of up to 4 microns in particle diameter contained in the developer occupy at most 10% in the particle number distribution.

2. The developing method as set forth in claim 1, wherein said electrically insulative toner is a magnetic toner consisting, at least, of a resin material and magnetic powder.

3. The developing method as set forth in claim 1, wherein said very fine powder particles which are smaller than said toner particles in diameter are hydrophobic.

4. The developing method as set forth in claim 1, wherein an alternating electric field is applied across said latent image holding member and said developer carrying member for development.

5. A developing method comprising:
(a) arranging a latent image holding member and a developer carrying member at spaced mutually opposed positions, and providing a space gap therebetween at a developing section, wherein said gap is maintained greater than a thickness of a developer layer applied on the surface of said developer carrying member;
(b) applying an alternating electric field across the space gap;
(c) using a developer prepared by mixing electrically insulative toner particles having an average particle diameter of from 5 microns to 30 microns with very fine powder particles having a smaller particle diameter than said toner particles and capable of assisting electric charging of said toner particles in a polarity opposite to that of a latent image, and wherein the toner particles of up to 15 microns in particle diameter contained in the developer occupy at least 90% in the particle number distribution; and
(d) removing by cleaning means the residual toner particles from said developer carrier.

6. A method according to claim 1 or 5 wherein said electrically insulating toner is of non-magnetic material.

7. A method according to claim 1 or 5, wherein said very fine powder particles are of aluminum oxide.

8. A method according to claim 1 or 5, wherein said very fine powder particles are of hydrophilic silica.

9. A method according to claim 1 or 5, wherein said very fine powder particles are of hydrophobic silica.

* * * * *